US010084237B2

(12) United States Patent
Liu et al.

(10) Patent No.: US 10,084,237 B2
(45) Date of Patent: Sep. 25, 2018

(54) INVERTED-F ANTENNA

(71) Applicant: ACCTON TECHNOLOGY CORPORATION, Hsinchu (TW)

(72) Inventors: Chang-Cheng Liu, Hsinchu (TW); I-Ru Liu, Hsinchu (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 358 days.

(21) Appl. No.: 15/167,374

(22) Filed: May 27, 2016

(65) Prior Publication Data

US 2017/0214141 A1 Jul. 27, 2017

(30) Foreign Application Priority Data

Jan. 25, 2016 (TW) ..... 105201088 U

(51) Int. Cl.

| | |
|---|---|
| ***H01Q 1/24*** | (2006.01) |
| ***H01Q 9/04*** | (2006.01) |
| ***H01Q 1/48*** | (2006.01) |
| *H01Q 13/00* | (2006.01) |
| *H01Q 1/00* | (2006.01) |
| *H01Q 9/16* | (2006.01) |

(52) U.S. Cl.

CPC ..... *H01Q 9/045* (2013.01); *H01Q 1/48* (2013.01); *H01Q 9/0414* (2013.01); *H01Q 1/00* (2013.01); *H01Q 1/24* (2013.01); *H01Q 9/16* (2013.01); *H01Q 13/00* (2013.01)

(58) Field of Classification Search

CPC H01Q 35/00; H01Q 1/24; H01Q 1/00; H01Q 13/00; H01Q 9/16

USPC ..... 343/700, 702, 720, 722, 730, 767, 793

See application file for complete search history.

(56) References Cited

U.S. PATENT DOCUMENTS

2016/0126632 A1* 5/2016 Ying ..... H01Q 9/045 343/702

* cited by examiner

*Primary Examiner* — Joseph Lauture

(74) *Attorney, Agent, or Firm* — Lynette Wylie; Apex Juris, pllc

(57) ABSTRACT

An inverted-F antenna includes a ground portion, a connecting portion, and a radiating portion, wherein the ground portion is adapted to be electrically connected to a ground line; the connecting portion is respectively connected to the ground portion and the radiating portion to respectively form two included angles therebetween; the radiating portion is separated from the ground portion by a distance due to the connecting portion; the radiating portion has a transceiving segment and a feed-in segment which are mutually connected, wherein the transceiving segment receives and transmits wireless signals in a specific frequency band, while the feed-in segment is adapted to be electrically connected to a signal line; a first notch and a second notch are formed on a side of the transceiving segment, wherein the feed-in segment extends from a portion between the first and the second notches. Whereby, the inverted-F antenna provides an omnidirectional radiation effect.

14 Claims, 17 Drawing Sheets

INVERTED-F ANTENNA

BACKGROUND OF THE INVENTION

1. Technical Field

The present invention generally relates to antennas, and more particularly to an inverted-F antenna.

2. Description of Related Art

The development of wireless communication in recent years has changed consumer's expectation of wireless communication devices (e.g., smartphones, tablets, laptops, wireless access points, etc.). Now such devices are expected not only to have basic communication functions, but also to support various communications protocols to exchange messages or to connect network. However, portable communication devices are also required to be small in size. Therefore, it has become a target in the industry to develop antennas with small size yet having good radiation performance to fit into a limited space.

Among all types of antennas, inverted-F antenna is more common for its simple structure, light weight, relative lower manufacturing cost, and high radiation performance. The combination of shape, structure, and even size of an inverted-F antenna would significantly affect impedance matching, operating frequency band, and radiation performance, etc. It would be welcome to have a new design of inverted-F antennas.

BRIEF SUMMARY OF THE INVENTION

In view of the reasons mentioned above, the primary objective of the present invention is to provide an inverted antenna, which could be easily manufactured with low manufacturing cost, and is capable of generating an omnidirectional radiation pattern.

The present invention provides an inverted-F antenna, which is adapted to be electrically connected to a signal line and a ground line. The inverted-F antenna includes a ground portion, a connecting portion, and a radiating portion. The ground portion is electrically connected to the ground line. The connecting portion has two opposite sides, wherein one side is connected to the ground portion, while the other side is connected to the radiating portion; the connecting portion is substantially perpendicular to the ground portion and the radiating portion respectively. The radiating portion is separated from the ground portion by a distance, with the connecting portion located therebetween; the radiating portion has a transceiving segment and a feed-in segment which are connected to each other; the transceiving segment receives and transmits wireless signals of a specific frequency band; the feed-in segment is electrically connected to the signal line; a first notch and a second notch are formed on a side of the transceiving segment, and the feed-in segment extends protrudently toward the ground portion from the position between the first notch and the second notch of the side of the transceiving segment.

The present invention further provides an inverted-F antenna, which is adapted to be electrically connected to a signal line and a ground line. The inverted-F antenna includes a ground portion, a connecting portion, and a radiating portion. The ground portion is electrically connected to the ground line. The connecting portion has a vertical segment and a horizontal segment; the vertical segment has two opposite sides, wherein one side is connected to the ground portion, and is substantially perpendicular to the ground portion; the horizontal segment is connected to the other side of the vertical segment, and is substantially parallel to the ground portion. The radiating portion has a first transceiving segment and a second transceiving segment; the first transceiving segment extends from a side of the horizontal segment toward a predetermined direction to receive and transmit wireless signals of a first frequency band; the second transceiving segment extends from the other side of the vertical segment toward the predetermined direction to receive and transmit wireless signals of a second frequency band; extending planes of the second transceiving segment and the first transceiving segment are substantially perpendicular to each other; a feed-in segment extends protrudently toward the ground portion from a side, which is far from the first transceiving segment, of the second transceiving segment, wherein the feed-in segment is adapted to be electrically connected to the signal line. In addition, a first gap is formed between the first transceiving segment and the second transceiving segment; a second gap is formed between the second transceiving segment, the connecting portion, and the ground portion.

With the design above, the inverted-F antenna could generate an omnidirectional radiation pattern.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
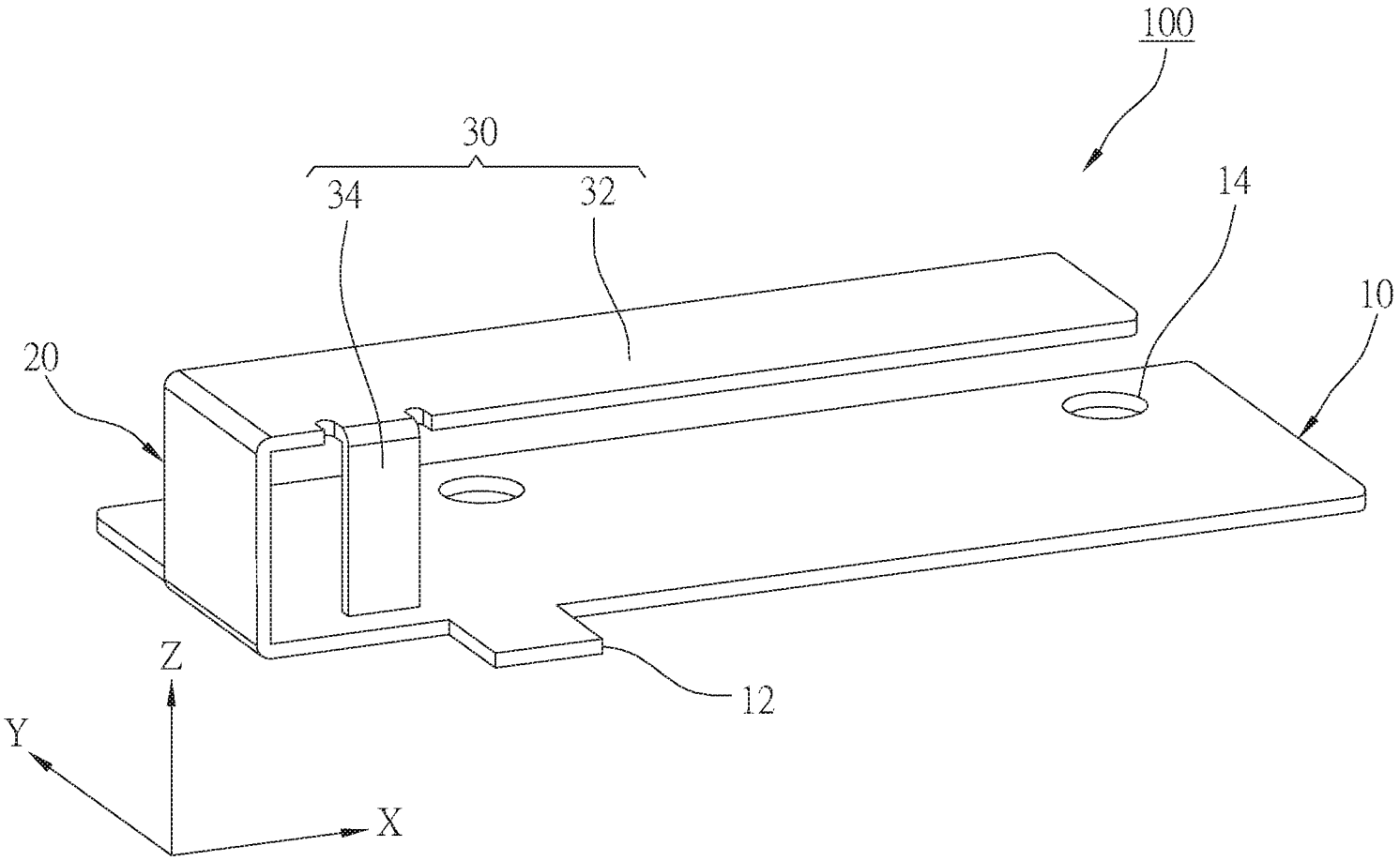
FIG. 1 is a perspective view of the inverted-F antenna of a first preferred embodiment.
Figure 2:
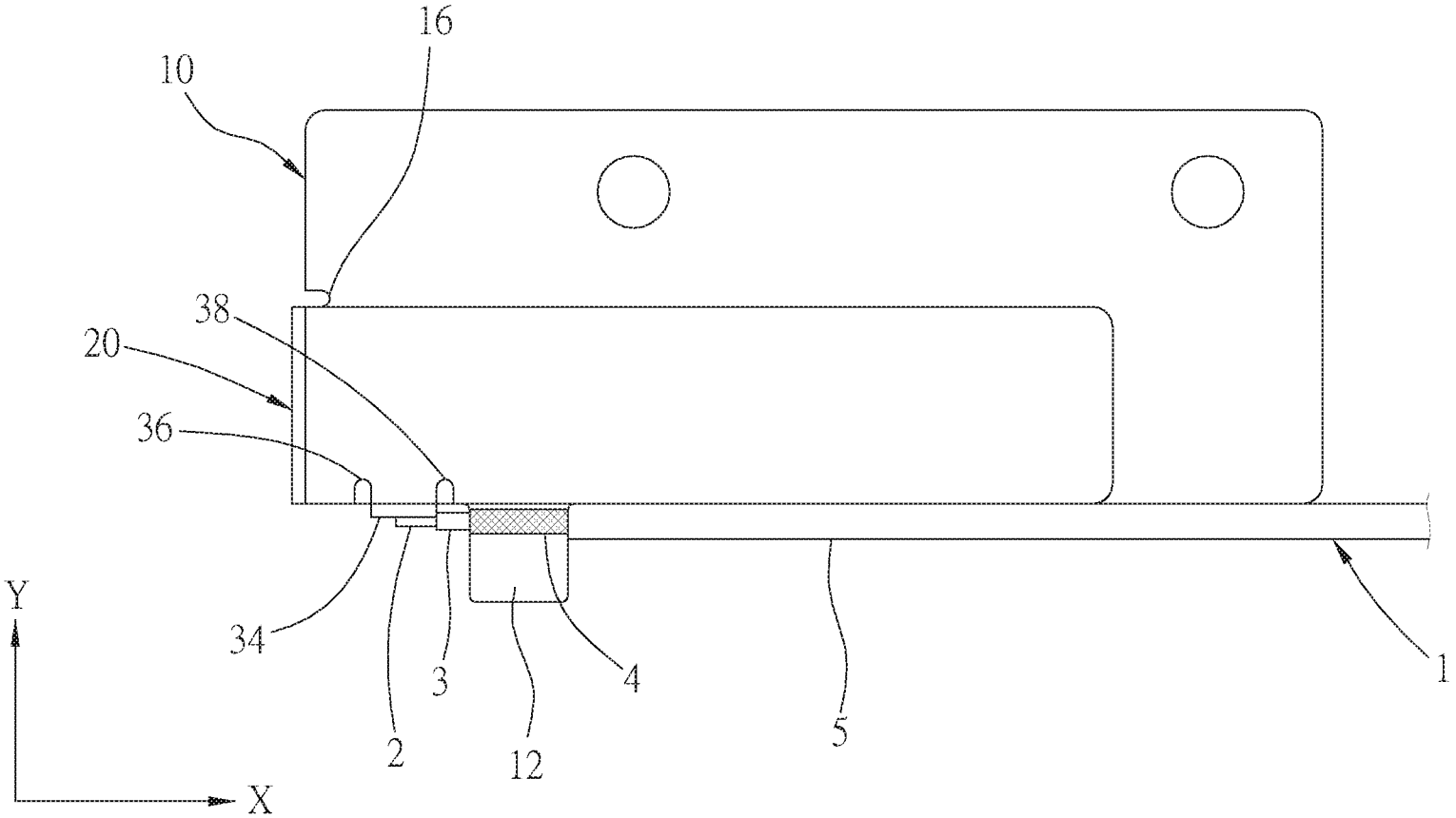
FIG. 2 is a top view of the inverted-F antenna of the first preferred embodiment, showing the inverted-F antenna is coupled to a transmission line.

An inverted-F antenna 100 of the first preferred embodiment of the present invention is illustrated in FIG. 1 and FIG. 2. The inverted-F antenna 100 can be made of one single conductive material (e.g., gold, silver, copper, iron, chromium, nickel, alloy, combination of the aforementioned materials, and other conductive materials) by stamping, pressing, or imprinting for at least once to be integrated into one piece; alternatively, the inverted-F antenna 100 can be made integrally as well. In the first preferred embodiment, the inverted-F antenna 100 is made of stainless steel by stamping, and is formed integrally. More specifically, 304 stainless steel is a preferred material, for it is unlikely to deform and can resist chemical oxidation, which ensures an enduring structure; furthermore, 304 stainless steel is adapted to be processed. Also, a surface of the inverted-F antenna 100 can be further plated with nickel, so that a signal line or a ground line can be easily welded or connected to the inverted-F antenna 100. To meet different requirements, the inverted-F antenna 100 can be, of course, made of other materials or made by different manufacturing methods.

The inverted-F antenna 100 is coupled to a transmission line 1, which is a coaxial cable in the first preferred embodiment, including, from inside to outside, a signal line 2 (or called an inner conductor), an inner insulating layer 3, a ground line 4 (or called an outer conductor), and an outer insulating layer 5, wherein the inner insulating layer 3 electrically separates the signal line 2 and the ground line 4, while the outer insulating layer 5 protects the transmission line inside. The inverted-F antenna 100 includes a ground portion 10, a connecting portion 20, and a radiating portion 30.

The ground portion 10 is substantially planar, which grounds the antenna. The ground portion 10 has a ground segment 12 extended outward from a side thereof, wherein the ground segment 12 bears the ground line 4, and is electrically connected to the ground line 4. In addition, the ground portion 10 is provided with a pair of positioning holes 14, through which a positioning member (not shown) could connect to or hold the antenna. The antenna can be fixed on a circuit board of a communication device in this way as an example and not a limitation.

The connecting portion 20 is also substantially planar, and has two opposite sides, wherein one side is connected to the ground portion 10, while the other side is connected to the radiating portion 30. Also, an included angle is formed between the connecting portion 20 and the ground portion 10, and another included angle is formed between the connecting portion 20 and the radiating portion 30. The connecting portion 20 not only connects and supports the ground portion 10 and the radiating portion 30, but also serves as a short circuit path on a side of the ground portion 10 and the radiating portion 30. For modularization purpose, it is preferred to make the connecting portion 20 substantially perpendicular to the ground portion 10 and the radiating portion 30 respectively.

The radiating portion 30 is separated from the ground portion 10 by a distance due to the connecting portion 20. The radiating portion 30 has a transceiving segment 32 and a feed-in segment 34 which are connected to each other. The transceiving segment 32 is also substantially planar, and is connected to the connecting portion 20 to receive and transmit wireless signals of a specific frequency band. In the present preferred embodiment, the specific frequency band refers to the frequency band across 2.4 GHz to 2.5 GHz. The feed-in segment 34 serves as a feed-in point of signals, and is electrically connected to the signal line 2. It is worth mentioning that, a first notch 36 and a second notch 38 are formed on a side of the transceiving segment 32 which corresponds to the extended ground segment 12, and the feed-in segment 34 is formed by extending from the position between the first notch 36 and the second notch 38 on said side and toward the ground portion 10, wherein the feed-in segment 34 is substantially perpendicular to the transceiving segment 32. The first notch 36 and the second notch 38 is provided for impedance matching between the transceiving segment 32 and the feed-in segment 34, which may reduce the signal loss after the signals passing through the transceiving segment 32 and the feed-in segment 34.

It is worth mentioning that, a distance between the feed-in segment 34 and the ground portion 10 is less than or equal to a distance between the feed-in segment 34 and the connecting portion 20. It is preferred that the distance between the feed-in segment 34 and the ground portion 10 is less than the distance between the feed-in segment 34 and the connecting portion 20. Whereby, the feed-in segment 34, the transceiving segment 32, the connecting portion 20, and the ground portion 10 together satisfy a boundary condition to form a resonant cavity, which generates resonance to radiate out the fed-in energy.

It is also worth mentioning that, a third notch 16 can be further provided near a junction of the ground portion 10 and the connecting portion 20 to provide the effect of impedance matching between the connecting portion 20 and the ground portion 10. Whereby, the signal loss could be reduced after the signals passing through the short circuit path between the ground portion 10 and the connecting portion 20.

Also, it is preferred that bottoms of the first notch 36, the second notch 38, and the third notch 16 are spherical, which provides the better effect of impedance matching and conducive to the transmission of signals.

Figure 3:
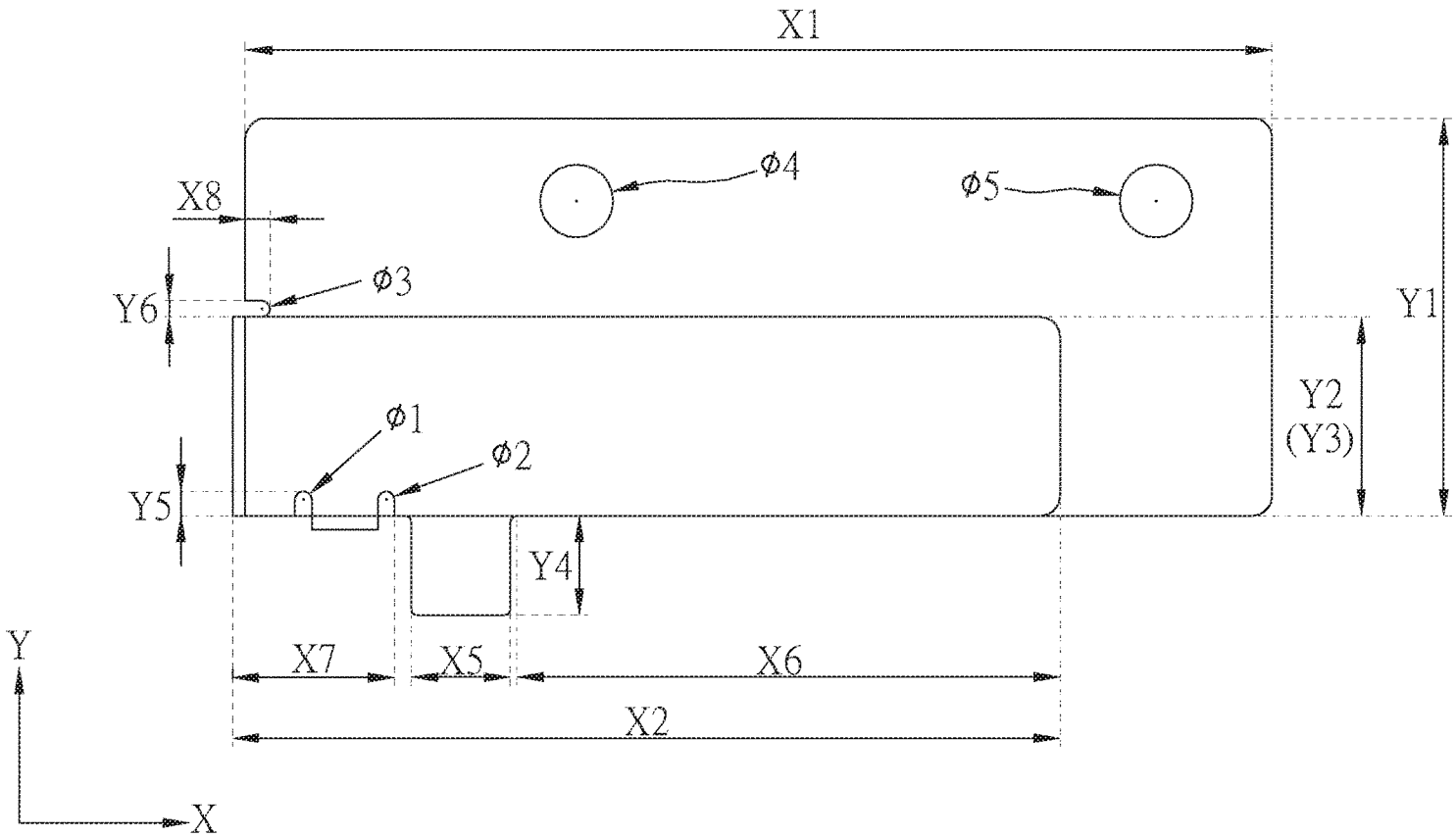
FIG. 3 is a top view of the inverted-F antenna of the first preferred embodiment, showing the size thereof.
Figure 4:
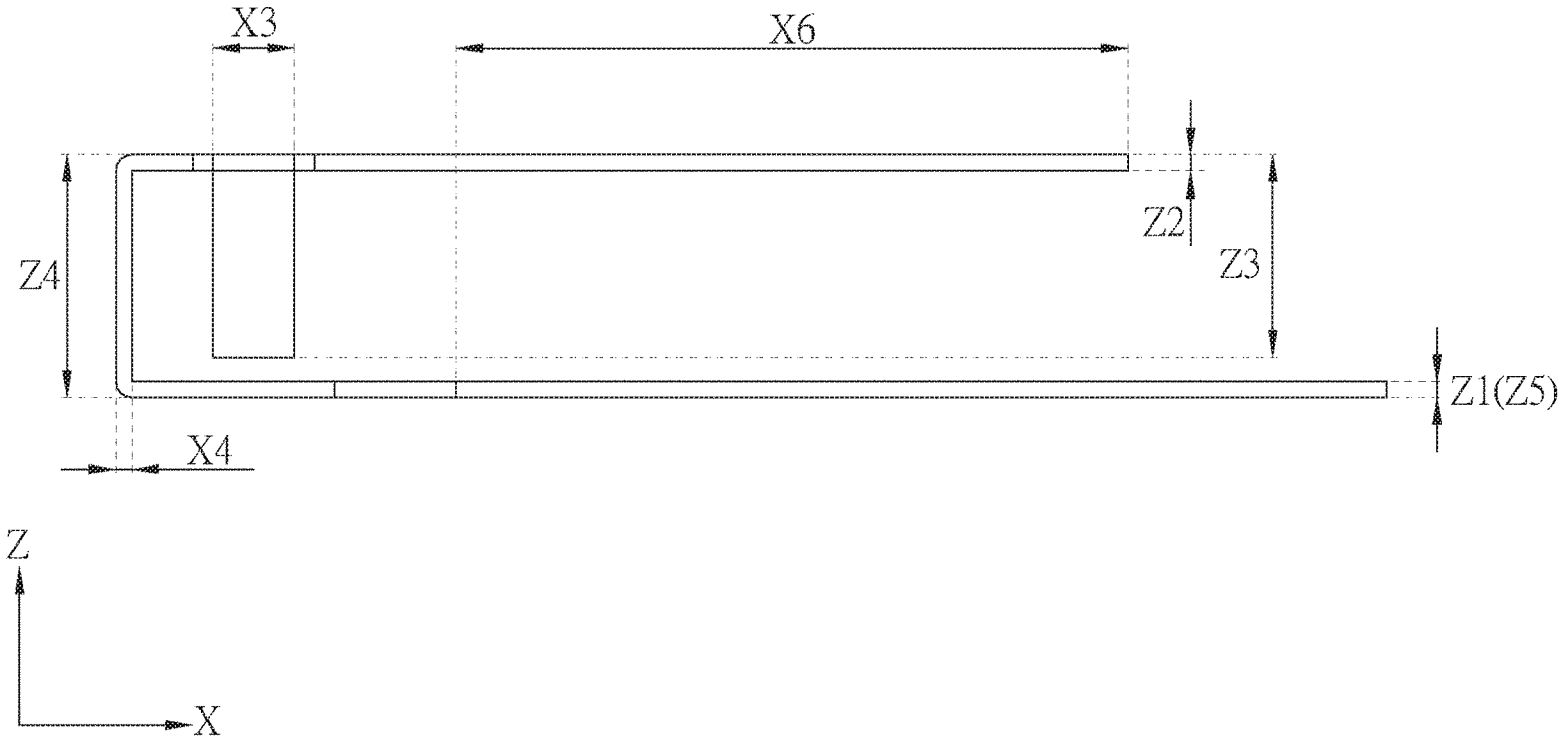
FIG. 4 is a lateral view of the inverted-F antenna of the first preferred embodiment, also showing the size thereof.

To provide a better omnidirectional effect for the inverted-F antenna 100 of the present invention in the frequency band across 2.4 GHz to 2.5 GHz, the inverted-F antenna 100 of the present invention can be designed to have the sizes and specifications illustrated in FIG. 3, FIG. 4, and Table 1-2 below. Herein we define a first axial direction X, a second axial direction Y, and a third axial direction Z to better describe the sizes of different parts of the antenna, wherein first axial direction X respectively perpendicular to the second axial direction Y and the third axial direction Z, while the second axial direction Y is perpendicular to the third axial direction Z.

TABLE 1

| Specifications of the inverted-F antenna 100 | | | | | |
|---|---|---|---|---|---|
| Mark | Size (mm) | Mark | Size (mm) | Mark | Size (mm) |
| X1 | 29 ≤ X1 ≤ 33 | Y1 | 10 ≤ Y1 ≤ 14 | Z1 | 0.3 ≤ Z1 ≤ 0.5 |
| X2 | 24 ≤ X2 ≤ 28 | Y2 | 5 ≤ Y2 ≤ 7 | Z2 | 0.3 ≤ Z2 ≤ 0.5 |
| X3 | 1 ≤ X3 ≤ 3 | Y3 | 5 ≤ Y3 ≤ 7 | Z3 | 4 ≤ Z3 ≤ 6 |
| X4 | 0.3 ≤ X4 ≤ 0.5 | Y4 | 2 ≤ Y4 ≤ 3 | Z4 | 5 ≤ Z4 ≤ 7 |
| X5 | 2 ≤ X5 ≤ 4 | Y5 | 0.65 ≤ Y5 ≤ 0.85 | Z5 | 0.3 ≤ Z5 ≤ 0.5 |
| X6 | 15 ≤ X6 ≤ 18 | Y6 | 0.4 ≤ Y6 ≤ 0.6 | | |
| X7 | 3.9 ≤ X7 ≤ 5.9 | | | | |
| X8 | 0.65 ≤ X8 ≤ 0.85 | | | | |

TABLE 2

| Specifications of the inverted-F antenna 100 | |
|---|---|
| Mark | Size (mm) |
| $\phi 1$ | $0.4 \le \phi 1 \le 0.6$ |
| $\phi 2$ | $0.4 \le \phi 2 \le 0.6$ |
| $\phi 3$ | $0.4 \le \phi 3 \le 0.6$ |
| $\phi 4$ | $1.9 \le \phi 4 \le 2.5$ |
| $\phi 5$ | $2.5 \le \phi 5 \le 1.9$ |

Wherein, X1 is a length of the ground portion 10 in the first axial direction X; X2 is a length of the transceiving segment 32 of the radiating portion 30 in the first axial direction X; X3 is a length of the feed-in segment 34 of the radiating portion 30 in the first axial direction X, or a width of the feed-in segment 34; X4 is a length of the connecting portion 20 in the first axial direction X, or is a thickness of the connecting portion 20; X5 is a length of the ground segment 12 in the first axial direction X; X6 is a distance in the first axial direction X between an open end of the transceiving segment 32 and a lateral edge of the ground segment 12 thereof projecting on the first axial direction X, wherein said lateral edge of the ground segment 12 is the one nearer to the open end of the transceiving segment 32 ; X7 is a maximum distance between a wall of the second notch 38 and the connecting portion 20 in the first axial direction X; X8 is a depth of the third notch 16 in the first axial direction X.

Wherein, Y1 is a length of the ground portion 10 in the second axial direction Y; Y2 is a length of the transceiving segment 32 of the radiating portion 30 in the second axial direction Y; Y3 is a length of the connecting portion 20 in the second axial direction Y; Y4 is a length of the ground segment 12 in the second axial direction Y; Y5 is a depth both of the first notch 36 and the second notch 38 in the second axial direction Y; Y6 is a width of the third notch 16 in the second axial direction Y.

Wherein, Z1 is a length of the ground portion 10 in the third axial direction Z, or is a thickness of the ground portion 10; Z2 is a length of the transceiving segment 32 of the radiating portion 30 in the third axial direction Z, or is a thickness of the radiating portion 30; Z3 is a length of the feed-in segment 34 of the radiating portion 30 in the third axial direction Z; Z4 is a length of the connecting portion 20 in the third axial direction Z; Z5 is a length of the ground segment 12 in the third axial direction Z.

Wherein, Φ1 is a diameter of a spherical surface of the bottom of the first notch 36, which equals a width of the first notch 36 in the first axial direction X; Φ2 is a diameter of a spherical surface of the bottom of the second notch 38, which equals a width of the second notch 38 in the first axial direction X; Φ3 is a diameter of a spherical surface of the bottom of the third notch 16, which equals a width of the third notch 16 in the second axial direction Y; Φ4 and Φ5 are respectively a diameter of each of the positioning holes 14.

The inverted-F antenna 100 of the present preferred embodiment of the present invention is preferred to be designed based on the specifications listed in table 3 and table 4 below.

TABLE 3

| Specifications of the inverted-F antenna 100 | | | | | |
|---|---|---|---|---|---|
| Mark | Size (mm) | Mark | Size (mm) | Mark | Size (mm) |
| X1 | 31 | Y1 | 12 | Z1 | 0.4 |
| X2 | 26 | Y2 | 6 | Z2 | 0.4 |
| X3 | 2 | Y3 | 6 | Z3 | 5 |
| X4 | 0.4 | Y4 | 2.5 | Z4 | 6 |
| X5 | 3 | Y5 | 0.75 | Z5 | 0.4 |
| X6 | 16.6 | Y6 | 0.5 | | |
| X7 | 4.9 | | | | |
| X8 | 0.75 | | | | |

TABLE 4

| Specifications of the inverted-F antenna 100 | |
|---|---|
| Mark | Size (mm) |
| $\phi 1$ | 0.5 |
| $\phi 2$ | 0.5 |
| $\phi 3$ | 0.5 |
| $\phi 4$ | 2.2 |
| $\phi 5$ | 2.2 |

Figure 5A:
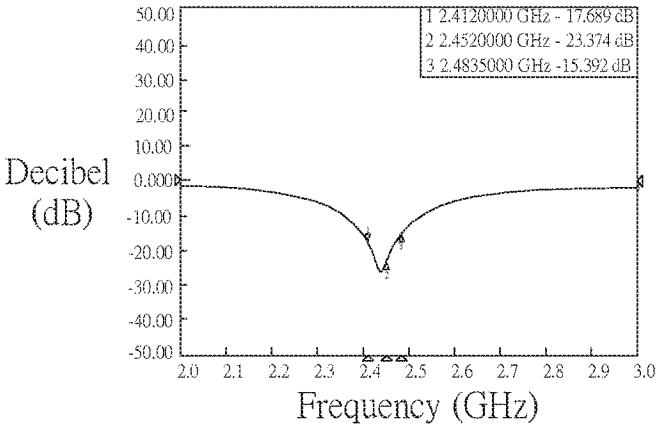
FIG. 5A is a simulation diagram of return loss based on the size illustrated in FIG. 3 and FIG. 4.

A simulated result of return loss is shown in FIG. 5A, which is simulated with the inverted-F antenna 100 of the first preferred embodiment designed based on the specifications listed in table 3 and table 4. As it can be clearly seen in FIG. 5A, a frequency bandwidth where the return loss of the inverted-F antenna 100 of the first preferred embodiment under −10 dB is indeed greater than 100 MHz, which meets the requirement that the frequency bandwidth where the return loss under −10 dB has to be greater than or equal to 100 MHz.

Figure 5B:
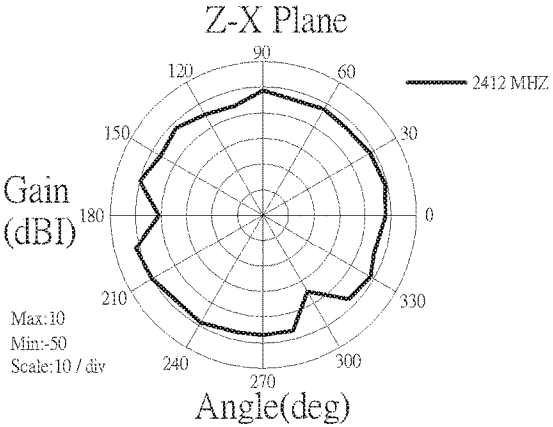
FIGS. 5B to 5D are simulated radiation pattern diagrams of the inverted-F antenna of the first preferred embodiment on the Z-X plane, which are operated across 2.4 GHz to 2.5 GHz.
Figure 5C:
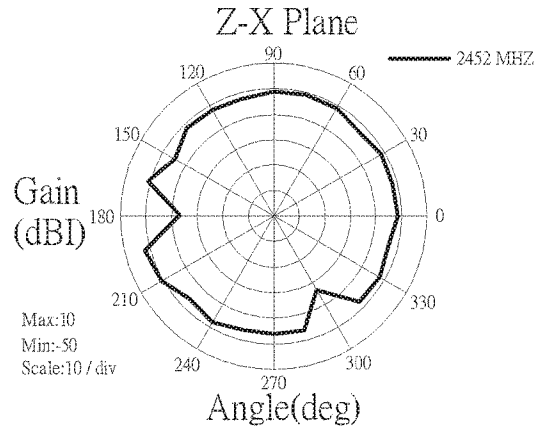
Figure 5D:
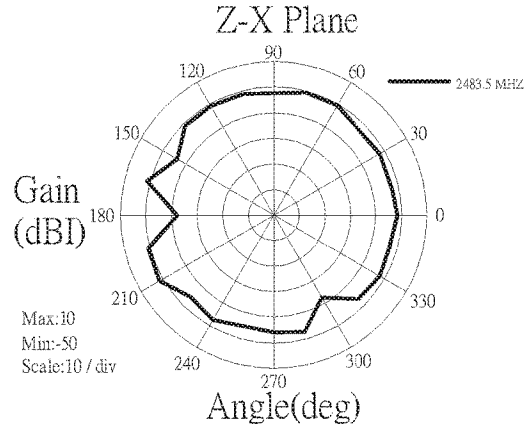
Figure 5E:
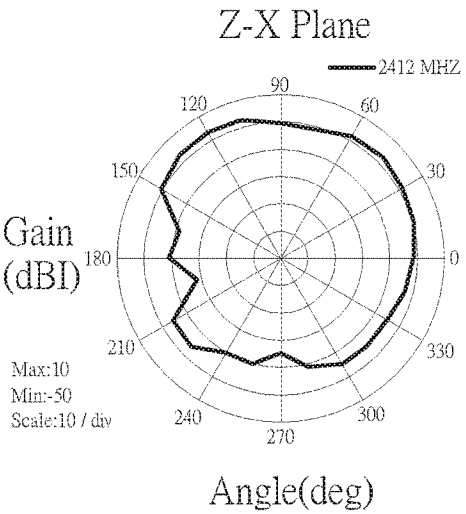
FIGS. 5E to 5G are simulated radiation pattern diagrams of the inverted-F antenna of the first preferred embodiment on the Z-Y plane, which are operated across 2.4 GHz to 2.5 GHz.
Figure 5F:
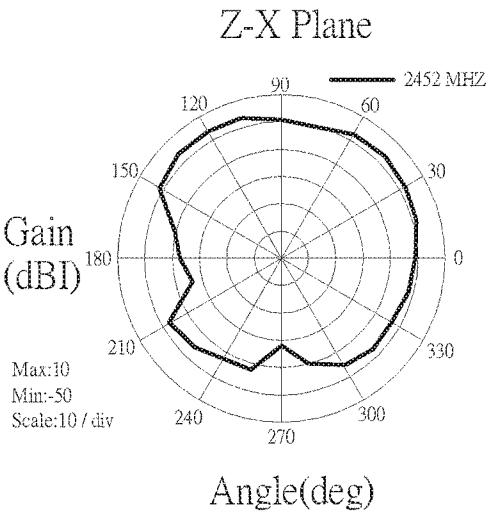
Figure 5G:
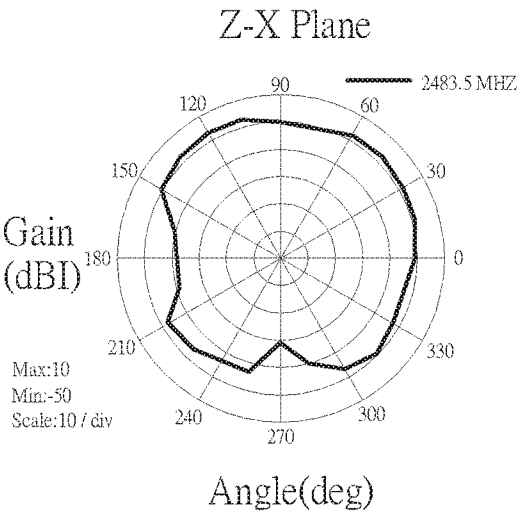
Figure 6:
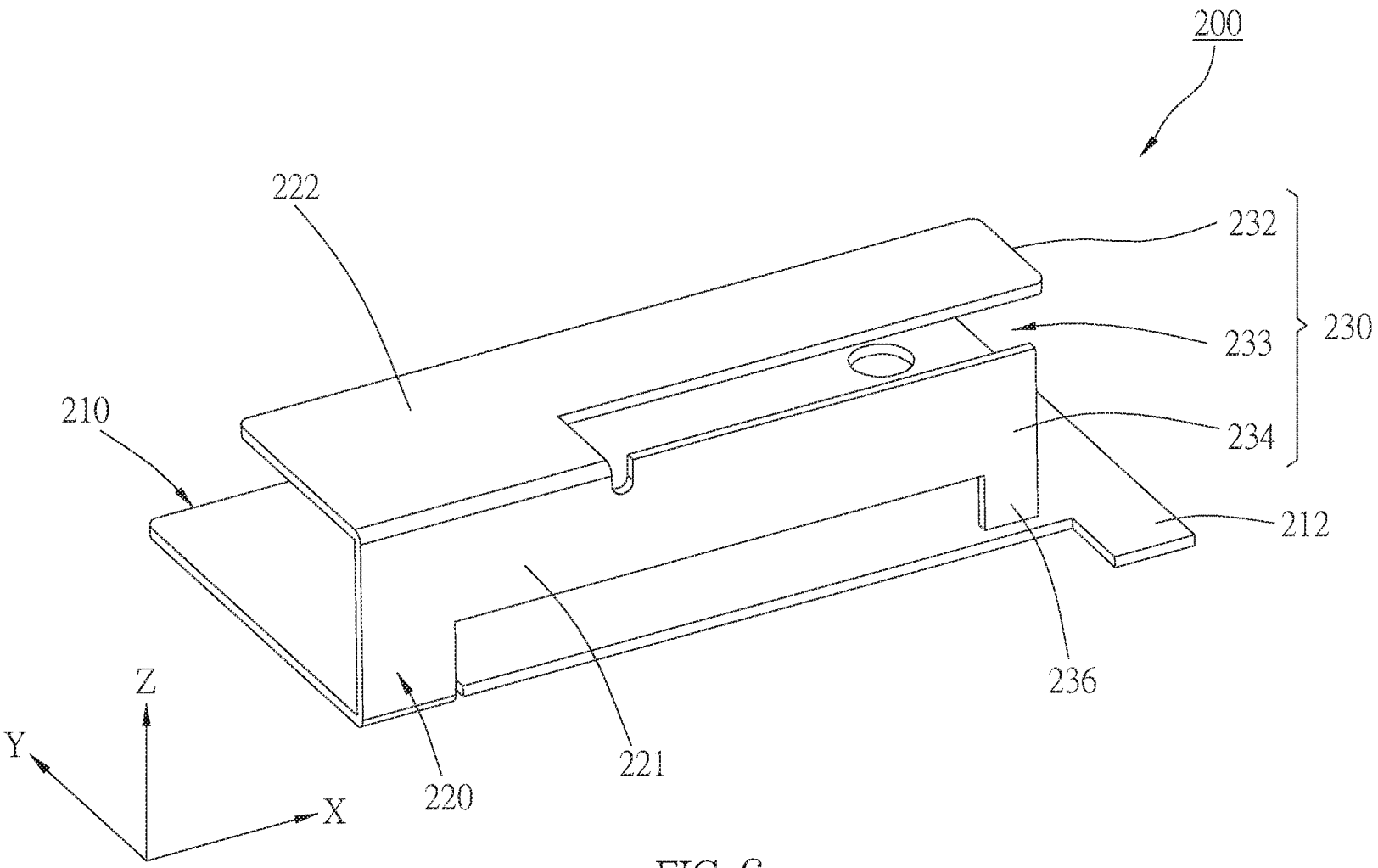
FIG. 6 is a perspective view of the inverted-F antenna of a second preferred embodiment.
Figure 7:
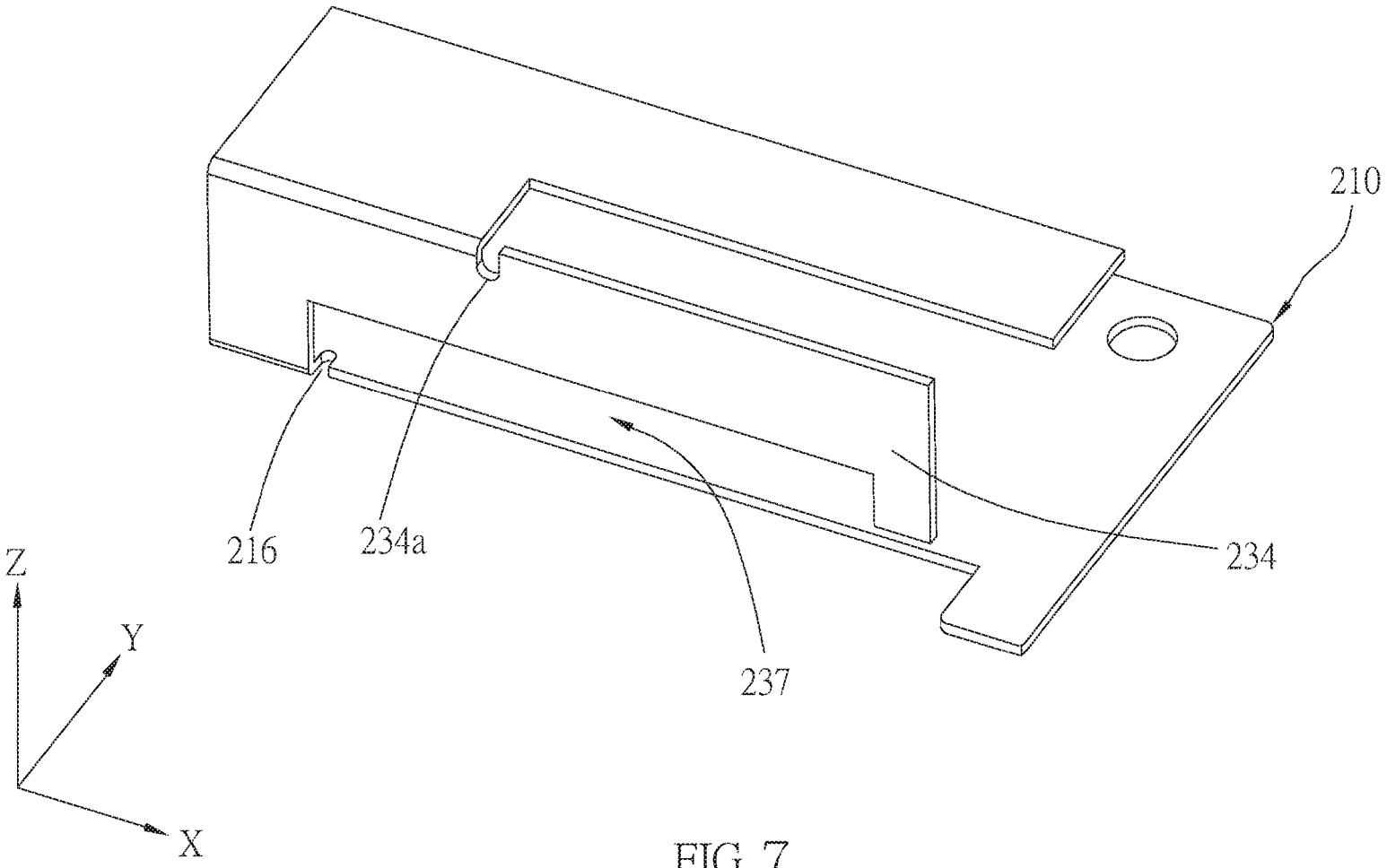
FIG. 7 is a perspective view of the inverted-F antenna of the second preferred embodiment seen from another view angle.
Figure 8:
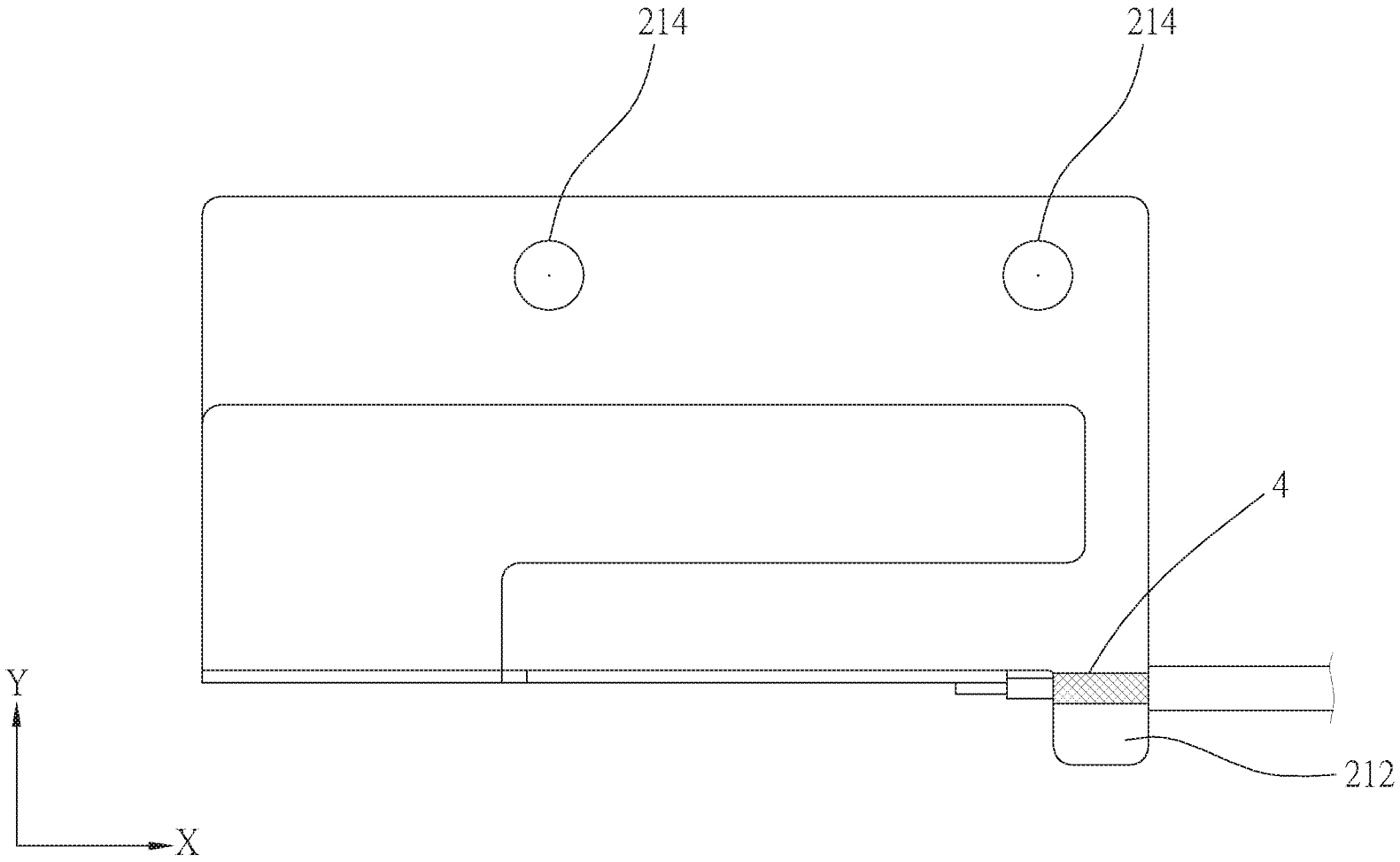
FIG. 8 is a top view of the inverted-F antenna of the second preferred embodiment, showing the inverted-F antenna is coupled to a transmission line.
Figure 9:
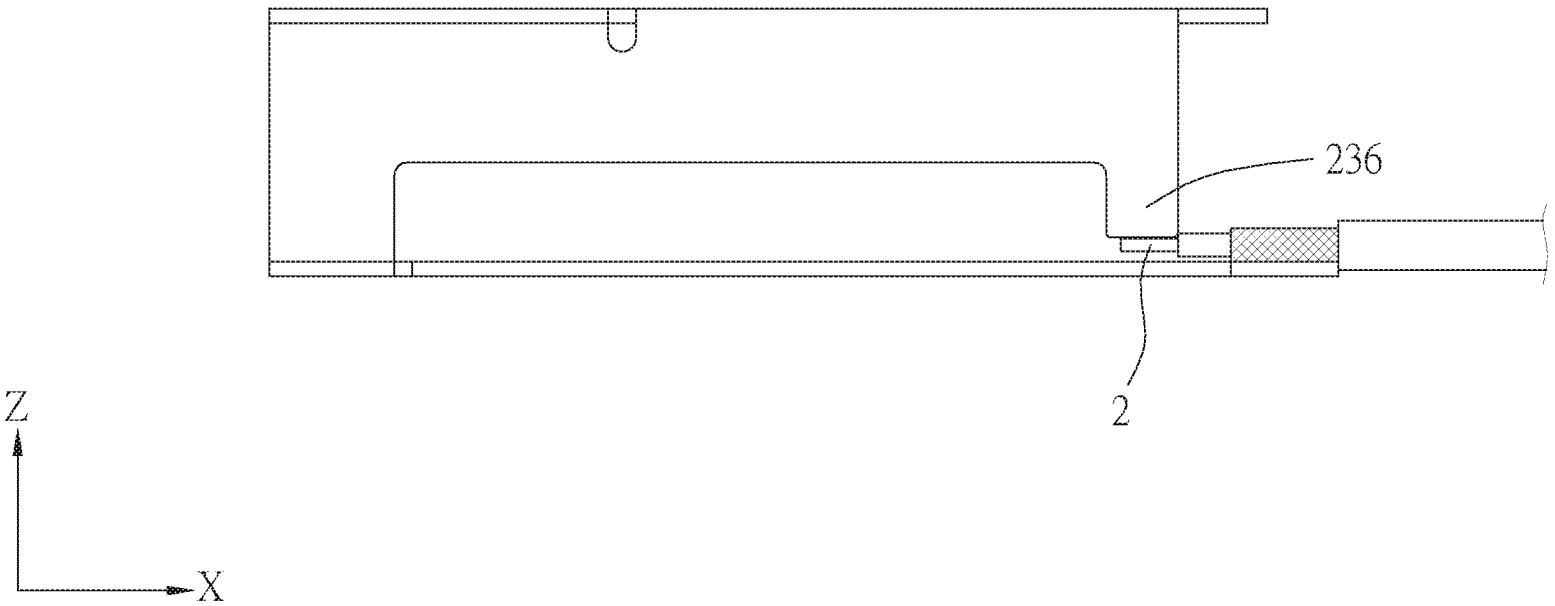
FIG. 9 is a lateral view of the inverted-F antenna of the second preferred embodiment, showing the inverted-F antenna is coupled to a transmission line.

For the inverted-F antenna 100 of the first preferred embodiment, simulated radiation pattern diagrams on the Z-X plane, which are operated across 2.4 GHz to 2.5 GHz, are shown in FIGS. 5B to 5D. On the other hand, simulated radiation pattern diagrams on the Z-Y plane, which are also operated across 2.4 GHz to 2.5 GHz, are shown in FIGS. 5E to 5G. It can be clearly seen in these figures that the inverted-F antenna 100 has an approximately spherical and circular radiation pattern.

Herein we take three frequencies (2412, 2452, and 2483.5 MHz) as examples to simulate the radiation efficiency and 3D gain, and the results are listed in Table 5 below. Obviously, the inverted-F antenna 100 of the present preferred embodiment does have the property of an omnidirectional antenna.

TABLE 5

| Frequency (MHz) | 2412 | 2452 | 2483.5 |
|---|---|---|---|
| Efficiency (%) | 76.05 | 73.41 | 72.38 |
| 3D Gain (dBi) | 4.50 | 4.91 | 5.25 |

An inverted-F antenna 200 of the second preferred embodiment of the present invention is illustrated in FIG. 6 to FIG. 9, which is the same with the first preferred embodiment in that, the inverted-F antenna 200 of the second preferred embodiment can be made of one single conductive material (e.g., gold, silver, copper, iron, chromium, nickel, alloy, combination of the aforementioned materials, and other conductive materials) by stamping, pressing, or imprinting for at least once to be integrated into one piece; alternatively, the inverted-F antenna 200 can be also made integrally initially. In the second preferred embodiment, the inverted-F antenna 200 is made of stainless steel by stamping, and is formed integrally. It is preferred to choose stainless steel No. 304 as the material, and the inverted-F antenna 200 can be coupled to a transmission line 1. These two preferred embodiments are different in that, the aforementioned inverted-F antenna 100 is designed for one single frequency band, while the inverted-F antenna 200 of the second preferred embodiment is designed for dual frequency bands. The structure of the inverted-F antenna 200 is explained below.

The inverted-F antenna 200 includes a ground portion 210, a connecting portion 220, and a radiating portion 230 which are connected to each other.

The ground portion 210 is substantially planar, and serves as the ground of the antenna. The ground portion 210 has a ground segment 212 extending outward from a side thereof, wherein the ground segment 212 bears the ground line 4, and is electrically connected to the ground line 4. The ground segment 212 is not limited to be completely on a same plane with the ground portion 210, but could be bent from the side thereof which is connected to the ground portion 210, which consequently forms an included angle between the ground segment 212 and the ground portion 210. Also, positioning holes 214 are further provided on the ground portion 210 to be connected to or to be held by a positioning member (not shown).

The connecting portion 220 has a vertical segment 221 and a horizontal segment 222 which are both substantially planar. The vertical segment 221 has two opposite sides, wherein one side is connected to the ground portion 210, and forms an included angle therebetween. The included angle formed between the vertical segment 221 and the ground portion 210 is preferred to be substantially a right angle. The horizontal segment 222 is connected to the other side of the vertical segment 221, and is substantially parallel to the ground portion 210. The connecting portion 220 supports and connects the ground portion 210 and the radiating portion 230, whereby the ground portion 210 is separated from the radiating portion 230 by a distance. Also, the connecting portion 220 serves as a short circuit path on a side of the ground portion 210 and the radiating portion 230.

The radiating portion 230 has a first transceiving segment 232 and a second transceiving segment 234 which are substantially planar, wherein the first transceiving segment 232 extends from a side of the horizontal segment 222 of the connecting portion 220 toward a predetermined direction. The first transceiving segment 232 is adapted to receive and transmit wireless signals of a first frequency band. The predetermined direction is preferred to be a planar extending direction of a plane parallel to the ground portion 210 in the second preferred embodiment, and said first frequency band refers to frequency band across 2.4 GHz to 2.5 GHz.

The second transceiving segment 234 extends from the vertical segment 221 of the connecting portion 220 toward a direction which is the same as the aforementioned predetermined direction, and is adapted to receive and transmit wireless signals of a second frequency band. In the second preferred embodiment, extending planes of the second transceiving segment 234 and the first transceiving segment 232 are preferred to be substantially perpendicular to each other, for they respectively extend from the vertical segment 221 and the horizontal segment 222 of the connecting portion 220. Said second frequency band refers to the frequency band about across 5 GHz to 6 GHz.

Also, a feed-in segment 236 extends protrudently from a side, which is farther from the connecting portion 220, of the second transceiving segment 234 toward the ground portion 210. The feed-in segment 236 serves as a feed-in point of signals, and is electrically connected to the signal line 2.

Also, a first gap 233 is formed between the first transceiving segment 232 and the second transceiving segment 234 to meet the boundary condition required for the first frequency band, whereby a resonant cavity is formed to generate resonance to radiate out the fed-in energy. To reduce the signal loss after the signals passing through junctions of the first transceiving segment 232, the connecting portion 220, and the second transceiving segment 234, a first notch **234*a* is formed on the second transceiving segment 234 at the junction of the second transceiving segment 234 and the vertical segment 221 of the connecting portion 220, wherein the first notch 234*a* gets through the first gap 233. Whereby, with the first notch 234*a*, the effect of impedance matching between the first transceiving segment 232, the connecting portion 220, and the second transceiving segment 234** can be achieved, which could reduce the signal loss while transmitting signals.

A second gap 237 is formed between the second transceiving segment 234, the vertical segment 221 of the connecting portion 220, and the ground portion 232 to meet the boundary condition required for the second frequency band, whereby a resonant cavity is formed to generate resonance to radiate out the fed-in energy. To reduce the signal loss after the signals passing through junctions of the second transceiving segment 234, the connecting portion 220, and the ground portion 210, a second notch 216 is formed on the ground portion 210 at the junction of connecting portion 220 and the ground portion 210, wherein the second notch 216 gets through the second gap 237. Whereby, with the second notch 216, the effect of impedance matching between the second transceiving segment 232, the connecting portion 220, and the ground portion 210 can be achieved, which could reduce the signal loss while transmitting signals.

Also, it is preferred that bottoms of the first notch **234*a* and the second notch 216** are spherical, which provides the better effect of impedance matching and conducive to the transmission of signals.

Figure 10:
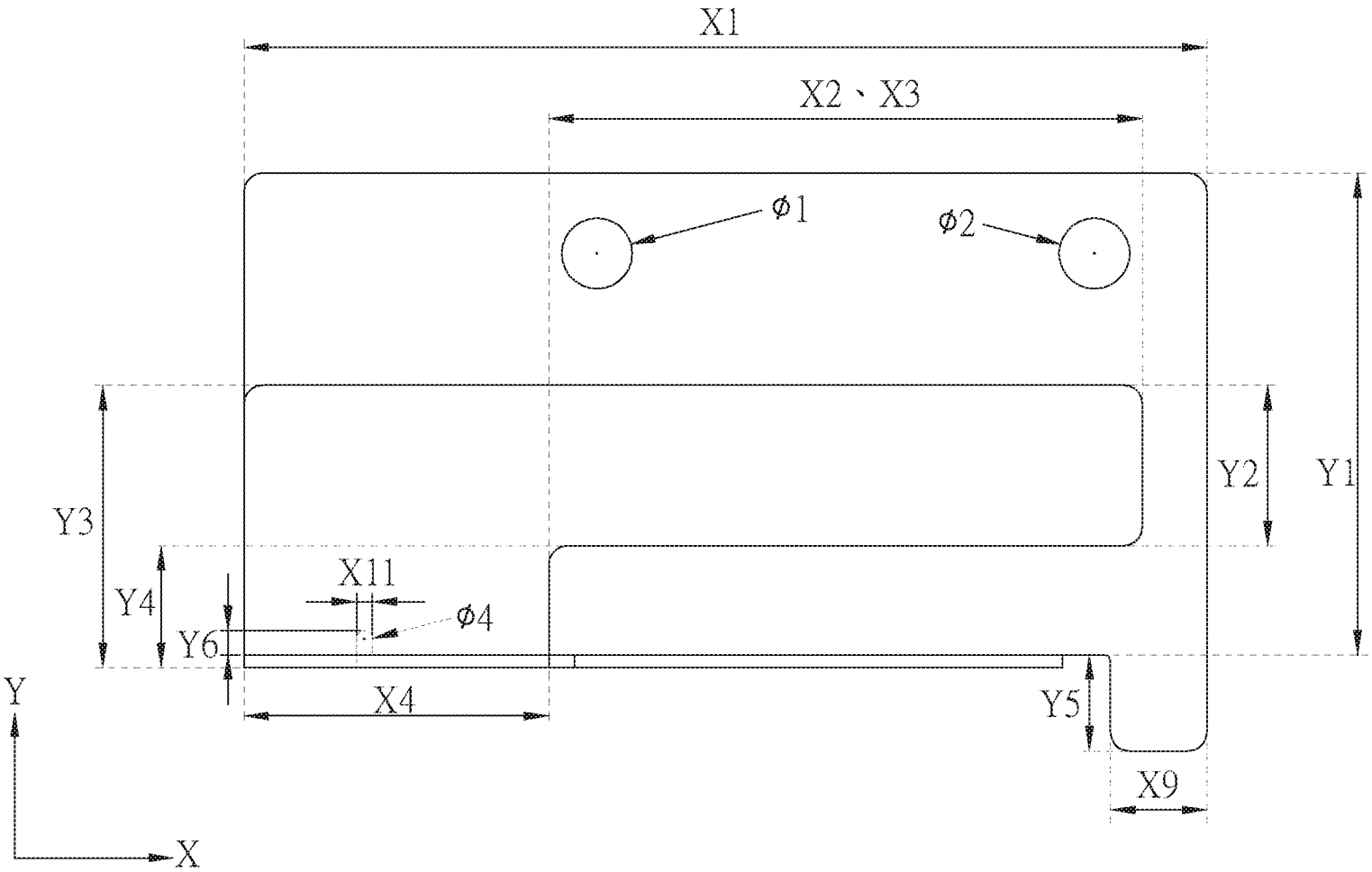
FIG. 10 is a top view of the inverted-F antenna of the second preferred embodiment, showing the size thereof.
Figure 11:
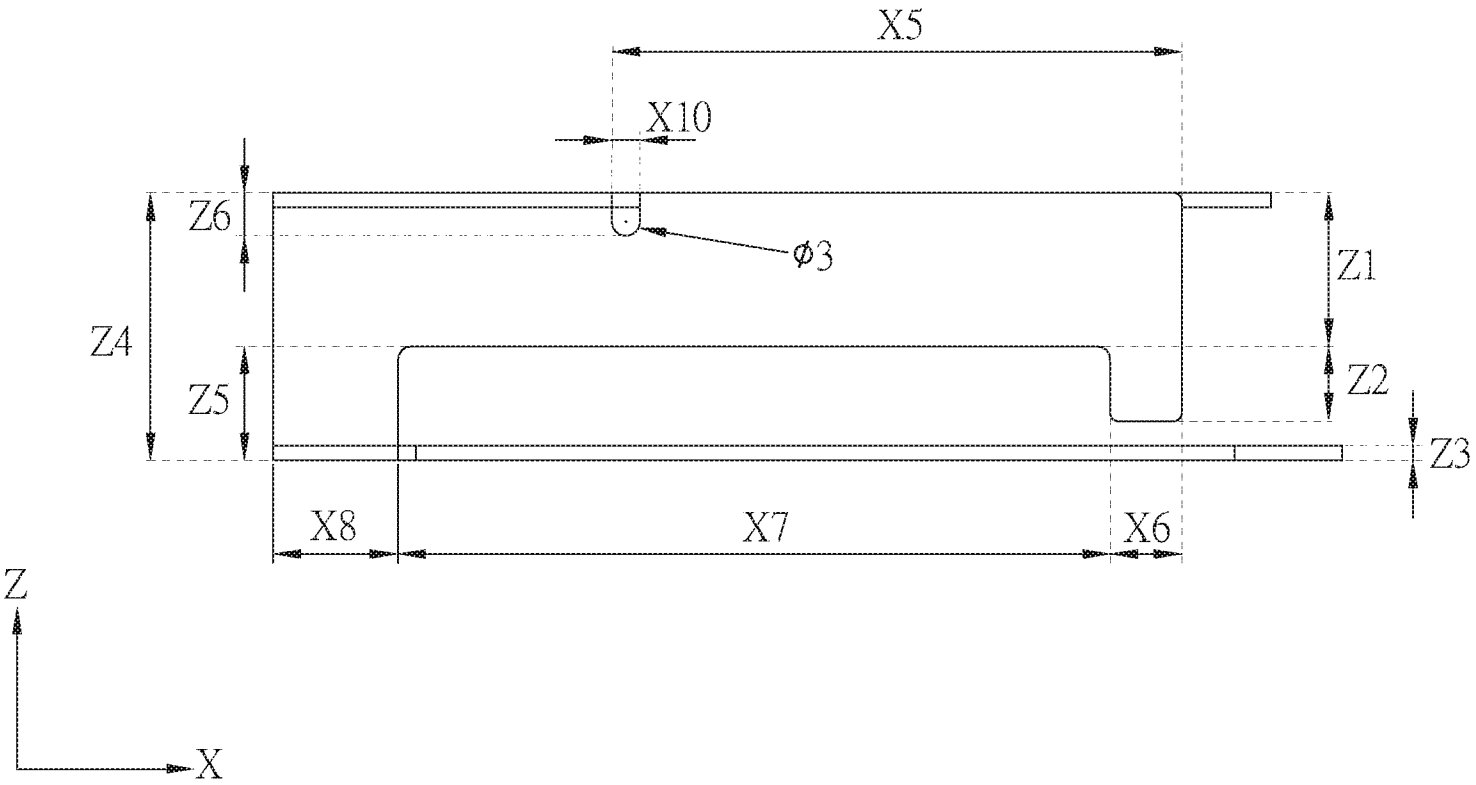
FIG. 11 is a lateral view of the inverted-F antenna of the second preferred embodiment, also showing the size thereof.

To provide a better omnidirectional effect for the inverted-F antenna 200 of the present invention in the first frequency band across 2.4 GHz to 2.5 GHz and the second frequency band across 5 GHz to 6 GHz, the inverted-F antenna 200 of the present invention can be designed to have the sizes and specifications illustrated in FIG. 10, FIG. 11, and Table 6-7 below. Herein we define a first axial direction X, a second axial direction Y, and a third axial direction Z to better describe the sizes of different parts of the antenna, wherein first axial direction X respectively perpendicular to the second axial direction Y and the third axial direction Z, while the second axial direction Y is perpendicular to the third axial direction Z.

TABLE 6

| Specifications of the inverted-F antenna 200 | | | | | |
|---|---|---|---|---|---|
| Mark | Size (mm) | Mark | Size (mm) | Mark | Size (mm) |
| X1 | 28 ≤ X1 ≤ 32 | Y1 | 14 ≤ Y1≤ 16 | Z1 | 3.3 ≤ Z1≤ 5.3 |
| X2 | 17 ≤ X2 ≤ 20 | Y2 | 4 ≤ Y2≤ 6 | Z2 | 1.1 ≤ Z2≤ 3.1 |
| X3 | 17 ≤ X3 ≤ 20 | Y3 | 7.8 ≤ Y3≤ 9.8 | Z3 | 0.3 ≤ Z3≤ 0.5 |
| X4 | 8.5 ≤ X4 ≤ 10.5 | Y4 | 2.5 ≤ Y4≤ 4.5 | Z4 | 6.5 ≤ Z4≤ 8.5 |
| X5 | 15 ≤ X5 ≤ 17 | Y5 | 2 ≤ Y5≤ 4 | Z5 | 2.2 ≤ Z5≤ 4.2 |
| X6 | 1 ≤ X6 ≤ 3 | Y6 | 1.1 ≤ Y5≤ 1.3 | Z6 | 1.1 ≤ Z6≤ 1.3 |
| X7 | 20 ≤ X7 ≤ 24 | | | | |
| X8 | 2.5 ≤ X8 ≤ 4.5 | | | | |
| X9 | 2 ≤ X9 ≤ 4 | | | | |
| X10 | 0.7 ≤ X10 ≤ 0.9 | | | | |
| X11 | 0.7 ≤ X11 ≤ 0.9 | | | | |

TABLE 7

| Specifications of the inverted-F antenna 200 | |
|---|---|
| Mark | Size (mm) |
| ϕ1 | 2.2 |
| ϕ2 | 2.2 |
| ϕ3 | 0.8 |

Wherein, X1 is a length of the ground portion 210 in the first axial direction X; X2 is a length of the first transceiving segment 232 of the radiating portion 30 in the first axial direction X; X3 is a length of the first gap 233 on a side facing the first transceiving segment 232 in the first axial direction (i.e., a depth of the first gap 233 on the side thereof); X4 is a length of the connecting portion 220 in the first axial direction X; X5 is a length of the second transceiving segment 234 in the first axial direction X; X6 is a length of the feed-in segment 236 in the first axial direction X; X7 is a length of a wall of the second gap 237 on a side facing the second transceiving segment 234 and the connecting portion 210 in the first axial direction X (i.e., a depth of the second gap 237 on the side thereof); X8 is a length of the junction of the connecting portion 220 and the ground portion 210 in the first axial direction X; X9 is a length of the ground segment 212 in the first axial direction X; X10 is a length of the first notch 234*a* in the first axial direction X (i.e., a width of the first notch 234*a*); X11 is a length of the second notch 216 in the first axial direction X (i.e., a width of the second notch 216).

Wherein, Y1 is a length of the ground portion 210 in the second axial direction Y; Y2 is a length of the first transceiving segment 232 in the second axial direction Y; Y3 is a length of the connecting portion 220 in the second axial direction Y; Y4 is a length of the first gap 233 in the second axial direction Y (i.e., a width of the first gap 233); Y5 is a length of the ground segment 212 in the second axial direction Y; Y6 is a length of the second notch 216 in the second axial direction Y (i.e., a depth of the second notch 216).

Wherein, Z1 is a length of the second transceiving segment 234 in the third axial direction Z without including the length of the feed-in segment 236; Z2 is a length of the feed-in segment 236 in the third axial direction Z; Z3 is a length of the ground portion 210 in the third axial direction Z, or is a thickness of the ground portion 210; Z4 is a length of the connecting portion 220 in the third axial direction Z; Z5 is a length of the second gap 237 in the third axial direction Z (i.e., a width of the second gap 237); Z6 is a length of the first notch 234*a* in the third axial direction Z (i.e., a depth of the first notch 234*a*).

Wherein, Φ1, Φ2 are respectively diameters of the aforementioned two positioning holes 214; Φ3 is a diameter of a spherical surface of the bottom first notch 234*a;* Φ4 is a diameter of a spherical surface of the bottom second notch 216.

The inverted-F antenna 200 of the first preferred embodiment of the present invention is preferred to be designed based on the specifications listed in table 8 and table 9 below.

TABLE 8

| Specifications of the inverted-F antenna 200 | | | | | |
|---|---|---|---|---|---|
| Mark | Size (mm) | Mark | Size (mm) | Mark | Size (mm) |
| X1 | 30 | Y1 | 15 | Z1 | 4.3 |
| X2 | 18.5 | Y2 | 5 | Z2 | 2.1 |
| X3 | 18.5 | Y3 | 8.8 | Z3 | 0.4 |
| X4 | 9.5 | Y4 | 3.5 | Z4 | 7.5 |
| X5 | 16 | Y5 | 3 | Z5 | 3.2 |
| X6 | 2 | Y6 | 1.2 | Z6 | 1.2 |
| X7 | 22 | | | | |
| X8 | 3.5 | | | | |
| X9 | 3 | | | | |
| X10 | 0.8 | | | | |
| X11 | 0.8 | | | | |

TABLE 9

| Specifications of the inverted-F antenna 200 | |
|---|---|
| Mark | Size (mm) |
| ϕ1 | 2.2 |
| ϕ2 | 2.2 |
| ϕ3 | 0.8 |

Figure 12A:
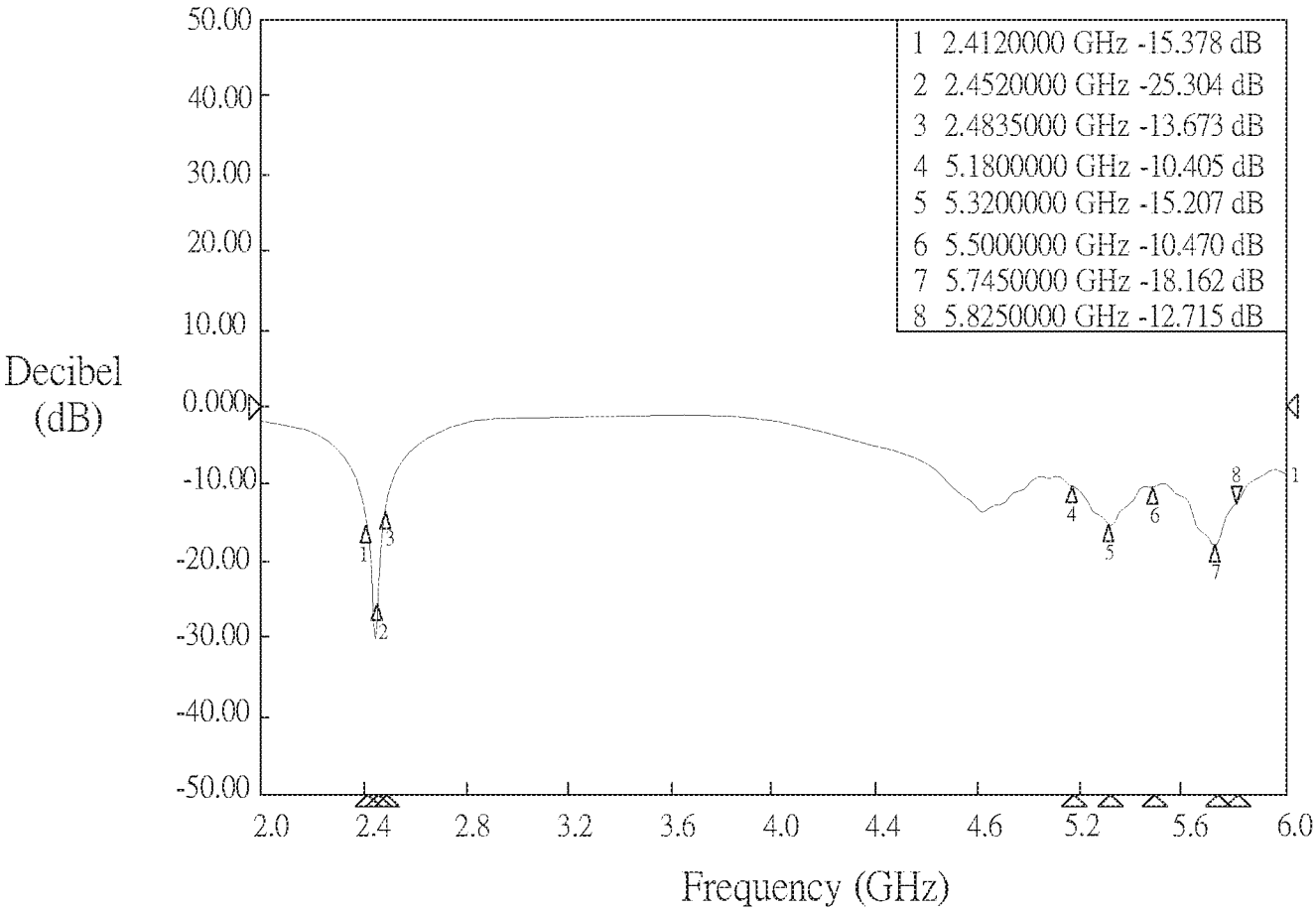
FIG. 12A is a simulation diagram of return loss based on the size illustrated in FIG. 10 and FIG. 11.
Figure 12B:
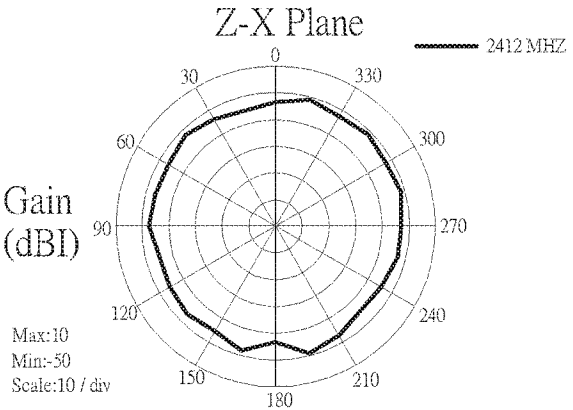
FIGS. 12B to 12D are simulated radiation pattern diagrams of the inverted-F antenna of the second preferred embodiment on the Z-X plane, which are operated in the first frequency band.
Figure 12C:
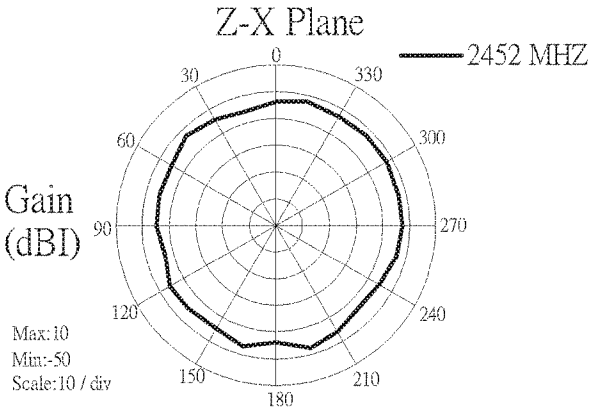
Figure 12D:
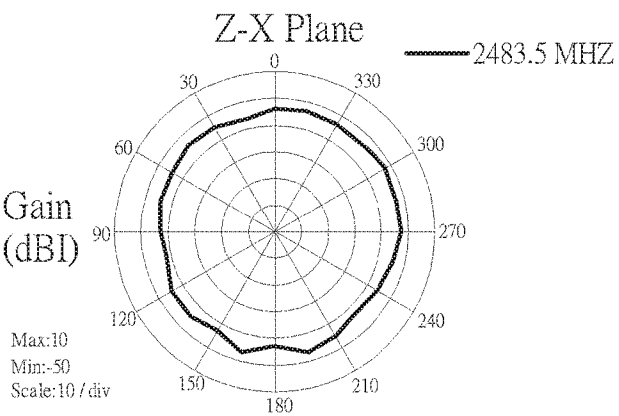
Figure 12E:
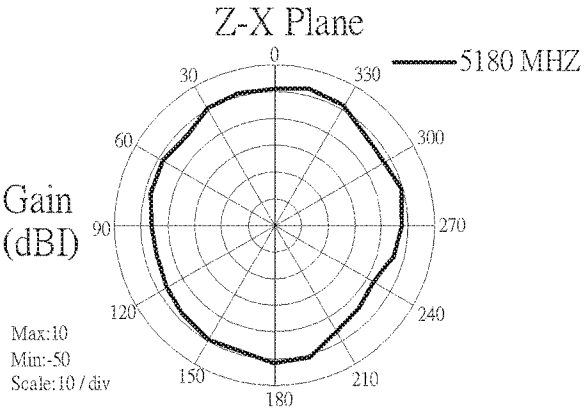
FIGS. 12E to 12I are simulated radiation pattern diagrams of the inverted-F antenna of the first preferred embodiment on the Z-X plane, which are operated in the second frequency band.
Figure 12F:
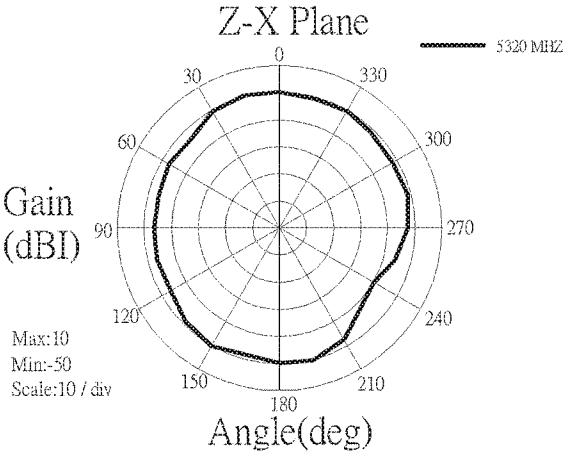
Figure 12G:
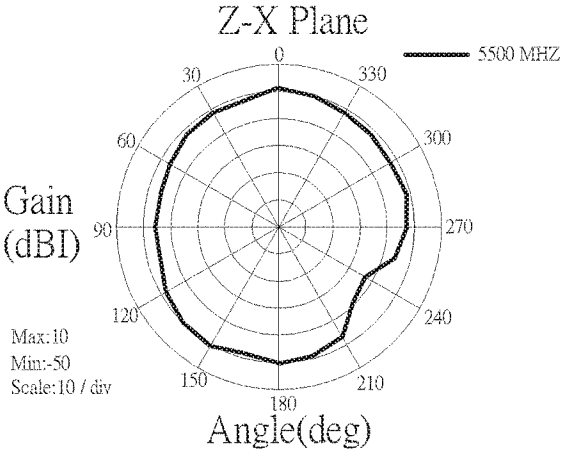
Figure 12H:
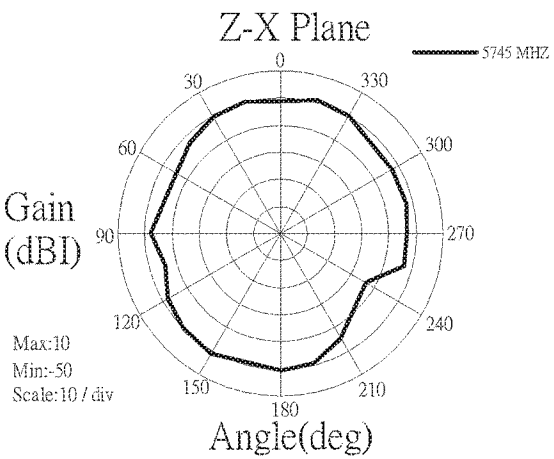
Figure 12I:
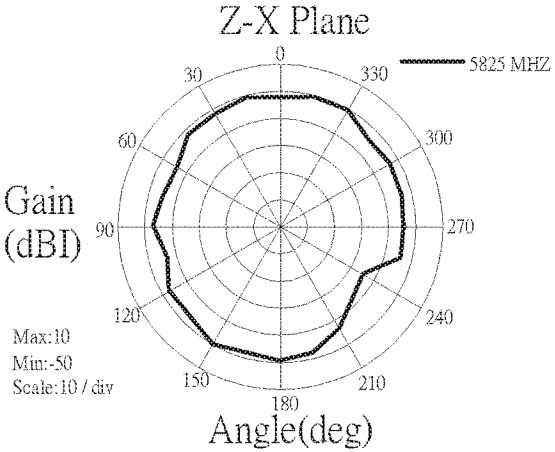
Figure 12J:
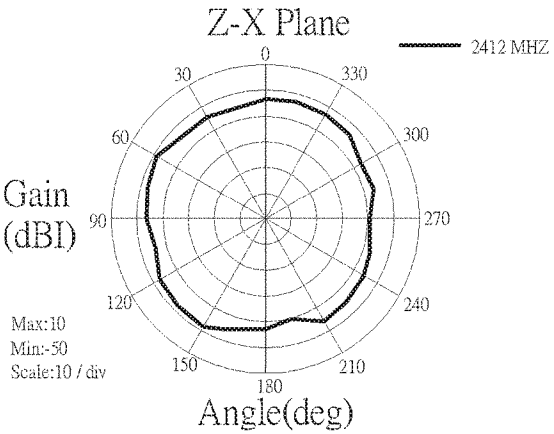
FIGS. 12J to 12L are simulated radiation pattern diagrams of the inverted-F antenna of the first preferred embodiment on the Z-Y plane, which are operated in the first frequency band.
Figure 12K:
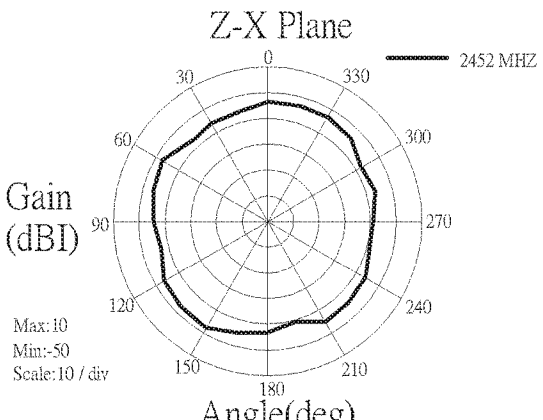
Figure 12L:
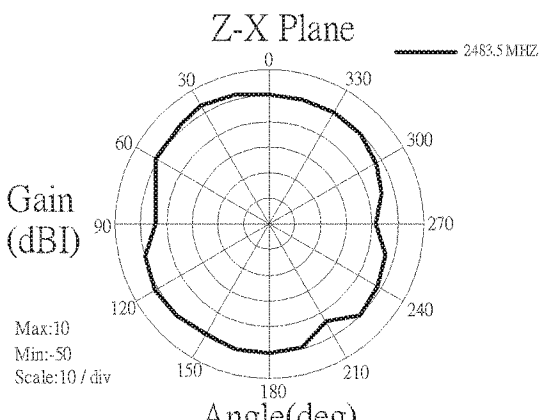
Figure 12M:
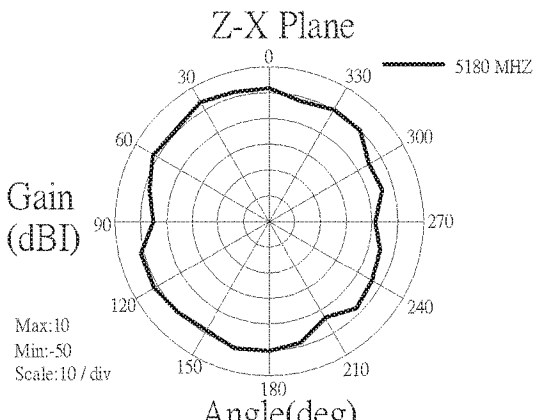
FIGS. 12M to 12Q are simulated radiation pattern diagrams of the inverted-F antenna of the first preferred embodiment on the Z-Y plane, which are operated in the second frequency band.
Figure 12N:
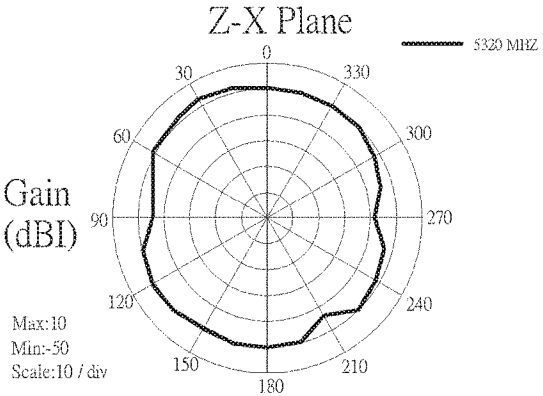
Figure 12O:
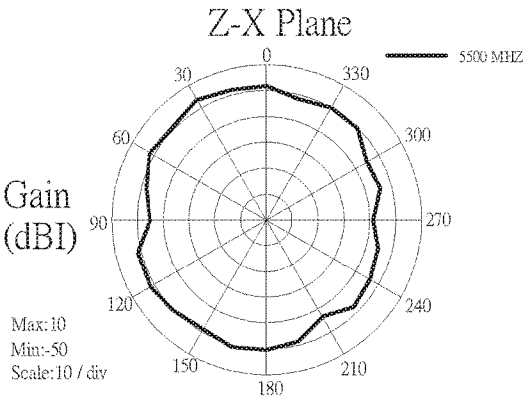
Figure 12P:
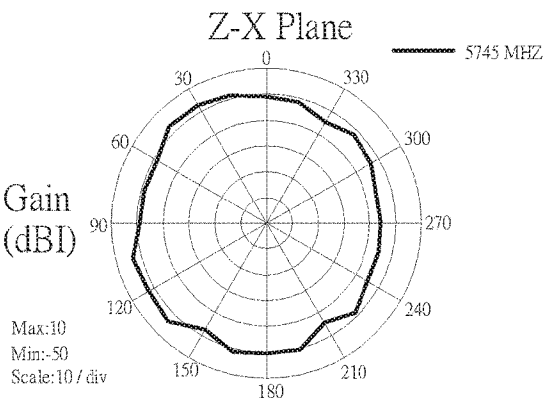
Figure 12Q:
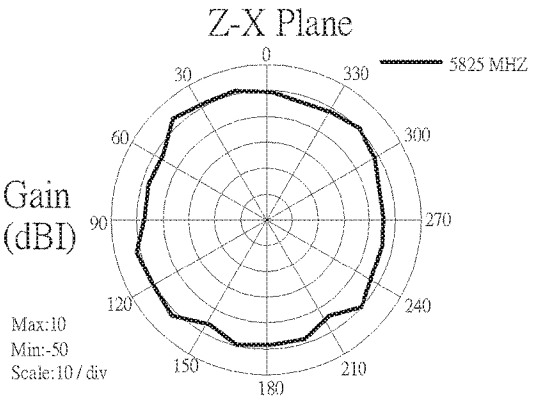

A simulated result of return loss is shown in FIG. 12A, which is simulated with the inverted-F antenna 200 of the second preferred embodiment designed based on the specifications listed in table 8 and table 9. As it can be clearly seen in FIG. 12A, the return loss of the inverted-F antenna 200 of the second preferred embodiment meets the requirement of under −10 dB both in the first frequency band (i.e., across 2.4 GHz to 2.5 GHz) and in the second frequency band (i.e., across 5 GHz to 6 GHz).

For the inverted-F antenna 200 of the second preferred embodiment, simulated radiation pattern diagrams on the Z-X plane, which are operated in the first and the second frequency bands, are shown in FIGS. 12B to 12I. On the other hand, simulated radiation pattern diagrams on the Z-Y plane, which are also operated in the first and the second frequency bands, are shown in FIGS. 12J to 12Q. It can be clearly seen in these figures that the inverted-F antenna 200 has an approximately spherical and circular radiation pattern in either the first frequency band or the second frequency band.

Herein we take eight frequencies (2412, 2452, 2483.5, 5180, 5320, 5500, 5745, and 5825 MHz) as examples to simulate the radiation efficiency and 3D gain, and the results are listed in Table 10 below. Obviously, the inverted-F antenna 200 of the second preferred embodiment does have the property of an omnidirectional antenna.

TABLE 10

| | Frequency (MHz) | | | | | | | |
|---|---|---|---|---|---|---|---|---|
| | 2412 | 2452 | 2483.5 | 5180 | 5320 | 5500 | 5745 | 5825 |
| Efficiency (%) | 73.83 | 75.78 | 73.97 | 74.98 | 72.47 | 62.13 | 73.13 | 71.02 |
| 3D Gain (dBi) | 4.61 | 4.69 | 4.32 | 6.29 | 6.62 | 5.46 | 5.05 | 4.98 |

Therefore, the inverted-F antennas 100, 200 provided in the present invention could provide good omnidirectional radiation effects, and can be selectively used to meet different requirements of different frequency bands. For example, the inverted-F antenna 100 of the first preferred embodiment is particularly suitable for Bluetooth communication devices. Of course, the inverted-F antennas 100, 200 can also be used in other types of wireless communication devices; being used in a Bluetooth communication device is merely an example, not a limitation of the present invention.

It must be pointed out that the embodiment described above is only one preferred embodiment of the present invention. It is worth mentioning that, in order to reduce the signal loss as low as possible for the signals passing through each component of the inverted-F antenna, it is preferred to make the ground portion, the connecting portion, and the radiating portion of each of the inverted-F antennas of the first and the second preferred embodiments have the same thickness. As a result, the problem of impedance mismatching can be reduced, and furthermore, the antenna can be produced and manufactured in a modularized way, which eases the difficulty in manufacturing such an antenna, and, therefore, lowers the cost of manufacturing. All equivalent structures which employ the concepts disclosed in this specification and the appended claims should fall within the scope of the present invention.

What is claimed is:

1. An inverted-F antenna, which is adapted to be electrically connected to a signal line and a ground line, comprising a ground portion, a connecting portion, and a radiating portion, wherein:

the ground portion is electrically connected to the ground line;

the connecting portion has two opposite sides, wherein one of the sides is connected to the ground portion, while the other side is connected to the radiating portion; the connecting portion is substantially perpendicular to the ground portion and the radiating portion respectively;

the radiating portion is separated from the ground portion by a distance; the radiating portion has a transceiving segment and a feed-in segment which are connected to each other; the transceiving segment receives and transmits wireless signals of a specific frequency band; the feed-in segment is electrically connected to the signal line; a first notch and a second notch are formed on a side of the transceiving segment, and the feed-in segment extends from the position between the first notch and the second notch of the side and toward the ground portion.

2. The inverted-F antenna of claim 1, wherein a distance between the feed-in segment and the ground portion is less than or equal to a distance between the feed-in segment and the connecting portion.

3. The inverted-F antenna of claim 1, wherein a ground segment extends from a side of the ground portion; the ground segment is adapted to be electrically connected to the ground line.

4. The inverted-F antenna of claim 3, which satisfies the following conditions:

29 mm≤X1≤33 mm;
24 mm≤X2≤28 mm;
1 mm≤X3≤3 mm;
0.3 mm≤X4≤0.5 mm;
2 mm≤X5≤4 mm;
10 mm≤Y1≤14 mm;
5 mm≤Y2≤7 mm;
5 mm≤Y3≤7 mm;
2 mm≤Y4≤3 mm
0.3 mm≤Z1≤0.5 mm;
0.3 mm≤Z2≤0.5 mm;
4 mm≤Z3≤6 mm;
5 mm≤Z4≤7 mm; and
0.3 mm≤Z5≤0.5 mm;

wherein, X1 is a length of the ground portion in a first axial direction; X2 is a length of the radiating portion in the first axial direction; X3 is a length of the feed-in segment in the first axial direction; X4 is a length of the connecting portion in the first axial direction; X5 is a length of the ground segment in the first axial direction; Y1 is a length of the ground portion in a second axial direction; Y2 is a length of the radiating portion in the second axial direction; Y3 is a length of the connecting portion in the second axial direction; Y4 is a length of the ground segment in the second axial direction; Z1 is a length of the ground portion in a third axial direction; Z2 is a length of the radiating portion in the third axial direction; Z3 is a length of the feed-in segment in the third axial direction; Z4 is a length of the connecting portion in the third axial direction; Z5 is a length of the ground segment in the third axial direction;

wherein, the first axial direction, the second axial direction, and the third axial direction are perpendicular to each other.

5. The inverted-F antenna of claim 4, wherein a width of the first notch in the first axial direction is between 0.4 mm and 0.6 mm, and a depth of the first notch in the second axial direction is between 0.65 mm and 0.85 mm; a width of the second notch in the first axial direction is between 0.4 mm and 0.6 mm, and a depth of the second notch in the second axial direction is between 0.65 mm and 0.85 mm; in the second axial direction, a distance between a wall of the second notch and the connecting portion is between 3.9 mm and 5.9 mm; a bottom of the first notch is a spherical surface, of which a diameter is between 0.4 mm and 0.6 mm, and a bottom of the second notch is a spherical surface, of which a diameter is between 0.4 mm and 0.6 mm.

6. The inverted-F antenna of claim 1, wherein a third notch is formed on the ground portion near the connecting portion.

7. The inverted-F antenna of claim 6, wherein a depth of the third notch in the first axial direction is between 0.65 mm and 0.85 mm, and a width of the third notch in the second axial direction is between 0.4 mm and 0.6 mm, and the first axial direction is vertical to the second axial direction.

8. An inverted-F antenna, which is adapted to be electrically connected to a signal line and a ground line, comprising a ground portion, a connecting portion, and a radiating portion, wherein:

the ground portion is electrically connected to the ground line;

the connecting portion has a vertical segment and a horizontal segment; the vertical segment has two opposite sides, wherein one of the sides is connected to the ground portion, and is substantially perpendicular to the ground portion; the horizontal segment is connected to the other side of the vertical segment, and is substantially parallel to the ground portion;

the radiating portion has a first transceiving segment and a second transceiving segment; the first transceiving segment extends from a side of the horizontal segment toward a predetermined direction to receive and transmit wireless signals of a first frequency band; the second transceiving segment extends from the other side of the vertical segment toward the predetermined direction to receive and transmit wireless signals of a second frequency band; extending planes of the second transceiving segment and the first transceiving segment are substantially perpendicular to each other; a feed-in segment extends from a side, which is farther from the first transceiving segment, of the second transceiving segment toward the ground portion, wherein the feed-in segment is adapted to be electrically connected to the signal line;

in addition, a first gap is formed between the first transceiving segment and the second transceiving segment; a second gap is formed between the second transceiving segment, the connecting portion, and the ground portion.

9. The inverted-F antenna of claim 8, wherein a first notch is formed at a junction of the second transceiving segment and the connecting portion; the first notch connects with the first gap.

10. The inverted-F antenna of claim 9, wherein the first notch satisfies the following conditions:

0.7 mm≤X10≤0.9 mm; and 1.1 mm≤Z6≤1.3 mm;

wherein X10 is a width of the first notch in a first axial direction, and Z6 is a depth of the first notch in a third axial direction; the first axial direction is perpendicular to the third axial direction.

11. The inverted-F antenna of claim 8, wherein a second notch is formed between the ground portion and the connecting portion; the second notch connects with the second gap.

12. The inverted-F antenna of claim 11, wherein the second notch satisfies the following conditions:

0.7 mm≤X11≤0.9 mm; and 1.1 mm≤Y6≤1.3 mm;

wherein X11 is a width of the second notch in a first axial direction, and Y6 is a depth of the second notch in a second axial direction; the first axial direction is perpendicular to the second axial direction.

13. The inverted-F antenna of claim 8, wherein a ground segment extends from a side of the ground portion; the ground segment is adapted to be electrically connected to the ground line.

14. The inverted-F antenna of claim 13, which satisfies the following conditions:

28 mm≤X1≤32 mm;

17 mm≤X2≤20 mm;

17 mm≤X3≤20 mm;

8.5 mm≤X4≤10.5 mm;

15 mm≤X5≤17 mm;

1 mm≤X6≤3 mm;

20 mm≤X7≤24 mm;

2.5 mm≤X8≤4.5 mm;

2 mm≤X9≤4 mm;

14 mm≤Y1≤16 mm;

4 mm≤Y2≤6 mm;

7.8 mm≤Y3≤9.8 mm;

2.5 mm≤Y4≤4.5 mm;

2 mm≤Y5≤4 mm;

3.3 mm≤Z1≤5.3 mm;

1.1 mm≤Z2≤3.1 mm;

0.3 mm≤Z3≤0.5 mm;

6.5 mm≤Z4≤8.5 mm; and 2.2 mm≤Z5≤4.2 mm;

wherein, X1 is a length of the ground portion in a first axial direction; X2 is a length of the first transceiving segment in the first axial direction; X3 is a length of the first gap on a side thereof facing the first transceiving segment in the first axial direction; X4 is a length of the connecting portion in the first axial direction; X5 is a length of the second transceiving segment in the first axial direction; X6 is a length of the feed-in segment in the first axial direction; X7 is a length of a wall of the second gap on a side thereof facing the second transceiving segment and the connecting portion in the first axial direction; X8 is a length of a junction of the connecting portion and the ground portion in the first axial direction; X9 is a length of the ground segment in the first axial direction;

wherein, Y1 is a length of the ground portion in a second axial direction; Y2 is a length of the first transceiving segment in the second axial direction; Y3 is a length of the connecting portion in the second axial direction; Y4 is a length of the first gap in the second axial direction; Y5 is a length of the ground segment in the second axial direction;

wherein, Z1 is a length of the ground segment in the second axial direction; Z2 is a length of the feed-in segment in the third axial direction; Z3 is a length of the ground portion in the third axial direction; Z4 is a length of the connecting portion in the third axial direction; Z5 is a length of the second gap in the third axial direction;

wherein, the first axial direction, the second axial direction, and the third axial direction are perpendicular to each other.

* * * * *